US006472824B2

(12) United States Patent
Hsiao

(10) Patent No.: US 6,472,824 B2
(45) Date of Patent: Oct. 29, 2002

(54) AUTOMATIC ON/OFF DEVICE FOR A LAMP

(76) Inventor: Fu-Tien Hsiao, No. 81, Section 2, Ho Pei Road, Taichung (TW)

( * ) Notice: Subject to any disclaimer, the term of this patent is extended or adjusted under 35 U.S.C. 154(b) by 0 days.

(21) Appl. No.: 09/750,852

(22) Filed: Dec. 29, 2000

(65) Prior Publication Data

US 2002/0070685 A1 Jun. 13, 2002

(51) Int. Cl.[7] ..... H05B 37/02

(52) U.S. Cl. ..... 315/158; 340/541; 340/573; 439/234

(58) Field of Search ..... 315/149, 158, 315/159, 291, 292, 307, 308, 309; 340/541, 565, 566, 567, 573, 691, 693; 439/229, 234

(56) References Cited

U.S. PATENT DOCUMENTS 5,498,931 A * 3/1996 Bedocs ..... 250/214 R 5,646,594 A * 7/1997 Barben et al. ..... 340/567

FOREIGN PATENT DOCUMENTS

JP 404181693 A * 6/1992
JP 409199279 A * 7/1997
JP 409199280 A * 7/1997

* cited by examiner

*Primary Examiner*—Don Wong
*Assistant Examiner*—Thuy Vinh Tran
(74) *Attorney, Agent, or Firm*—Alan D. Kamrath; Rider, Bennett, Egan & Arundel

(57) ABSTRACT

An automatic on/off device comprises a mounting member removably attached to a lamp and a sensor mounted in the mounting member. The sensor includes a power input end for contacting with a power connection of the lamp to form a circuit for controlling on/off of the lamp. The mounting member includes a holding portion for engaging with a portion of the lamp.

15 Claims, 8 Drawing Sheets

AUTOMATIC ON/OFF DEVICE FOR A LAMP

BACKGROUND OF THE INVENTION

1. Field of the Invention

The present invention relates to an automatic on/off device for a lamp, and more particularly to a device for turning on a lamp when it detects a person entering a predetermined spatial area.

2. Description of the Related Art

A typical infrared sensor is mounted on top of a doorframe and is electrically connected to a lamp on the doorframe by a wire. When a person approaches the door, the lamp is turned on. Nevertheless, a long wire is required to connect the infrared sensor with the lamp. In addition, an extra wire is further required for connection with an indoor lighting device. Troublesome and costly installation is required when the indoor lighting device includes several lighting elements. The wires for connection are long and may be disconnected if the wires are inadvertently impinged. The internal metal cores in the wires may be exposed and cause injury if the outer insulating covering of the wires strips. An attempt to bury the wires in walls would require drilling and thus adversely affect the appearance of the walls, and the cost for drilling is high. Furthermore, installation of the infrared sensor requires a professional worker.

SUMMARY OF THE INVENTION

It is an object of the present invention to provide an automatic on/off device for a lamp that can be easily attached to the lamp by the user without the need of a professional worker.

It is another object of the present invention to provide an automatic on/off device that can be directly attached to a lamp that is currently in use without the need of long wires.

It is a further object of the present invention to provide an automatic on/off device that can be mounted in a lamp base for a lamp in a factory.

In accordance with a first aspect of the invention, an automatic on/off device comprises a sensing means including a power input end for contacting with a power connection of a lamp to form a circuit for controlling on/off of the lamp.

In accordance with a second aspect of the invention, an automatic on/off device comprises a mounting member removably attached to a lamp and a sensing means mounted in the mounting member. The sensing means includes a power input end for contacting with a power connection of the lamp to form a circuit for controlling on/off of the lamp.

In accordance with a third aspect of the invention, an automatic on/off device comprises a mounting member removably attached to a lamp, a sensing means mounted in the mounting member, and a panel. The mounting member has an opening in a side thereof. The sensing means includes an integrated circuit board, a control chip mounted on the integrated circuit board, and a sensor mounted in the mounting member and having a portion exposed outside the mounting member. The sensor includes a power input end for contacting with a power connection of the lamp to form a circuit for controlling on/off of the lamp under cooperation by the control chip. The panel is removably mounted to the side of the mounting member for covering the opening. The integrated circuit board is securely mounted to the panel.

In an embodiment of the invention, the mounting member includes an engaging slot, and the panel includes a protrusion for releasably engaging with the engaging slot. The lamp includes a fluorescent bulb having two ends. Each end of the fluorescent bulb has a base and two tube pins. The sensor has two leads in contact with the tube pins, respectively. The panel includes a slot through which the leads of the sensor extend out of the mounting member for contacting with the tube pins of the fluorescent bulb. The mounting member has a hole through which a portion of the sensor is exposed outside the lamp base. The sensor has a lower portion and a flange above the lower portion, wherein the flange has an outer diameter greater than a diameter of the hole of the mounting member and the lower portion of the sensor has an outer diameter smaller than the diameter of the hole of the mounting member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
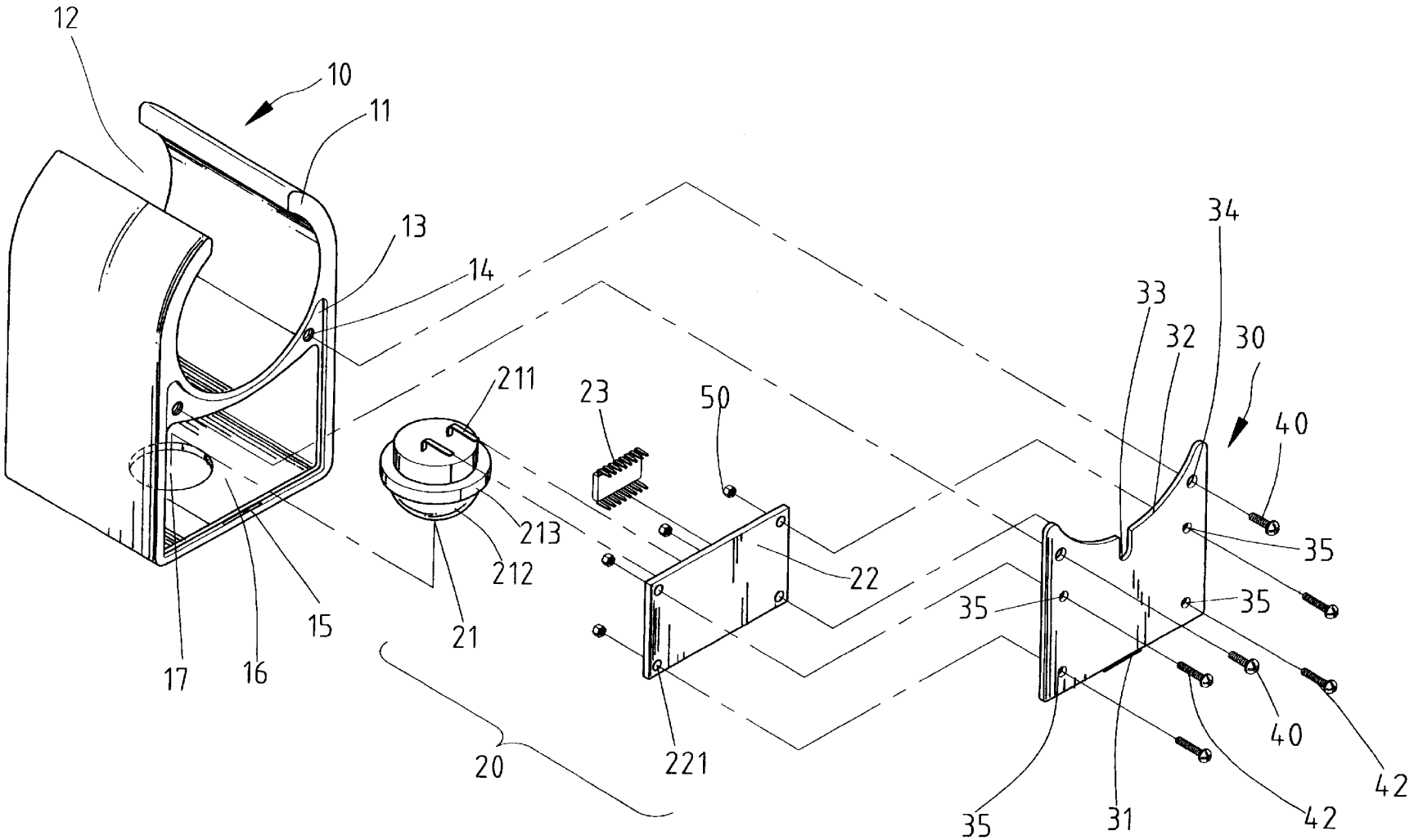
FIG. 1 is an exploded perspective view of an automatic on/off device for a lamp in accordance with the present invention.

Referring to FIG. 1, an automatic on/off device in accordance with the present invention generally includes a mounting member 10, a sensing means 20, and a panel 30. The mounting member 10 includes a substantially C-shape holding portion 11 that defines a space 12 with an upwardly facing opening (not labeled). A side of the mounting member 10 includes a compartment 16 with an opening (not labeled). The side of the mounting member 10 includes an engaging slot 15. The side of the mounting member 10 further includes a recessed portion 13 surrounding the opening of the compartment 16 and having screw holes 14, which will be described later. A bottom wall defining the compartment 16 includes a hole 17.

The sensing means 20 includes a sensor 21, an integrated circuit board 22, and a control chip 23. The sensor 21 includes a power input end (e.g., in the form of a pair of leads 211) in contact with wires from a power source for supplying power. The sensor 21 includes a lower end 212 and a flange 213 above the lower end 212, the flange 213 having an outer diameter greater than the hole 17 in the mounting member 10, the lower end 212 of the sensor 21 having an outer diameter smaller than the diameter of the hole 17. The control chip 23 is mounted on the integrated circuit board 22 that includes a circuit thereon. In an alternative design, the sensor 21 may be mounted on the integrated circuit board 22.

The panel 30 includes a protrusion 31 on a bottom thereof for releasably engaging with the engaging slot 15 of the mounting member 10. The panel 30 further includes a notch 33 in an arcuate upper side 32 thereof. The notch 33 may be replaced by a slot in the panel 30.

Figure 2:
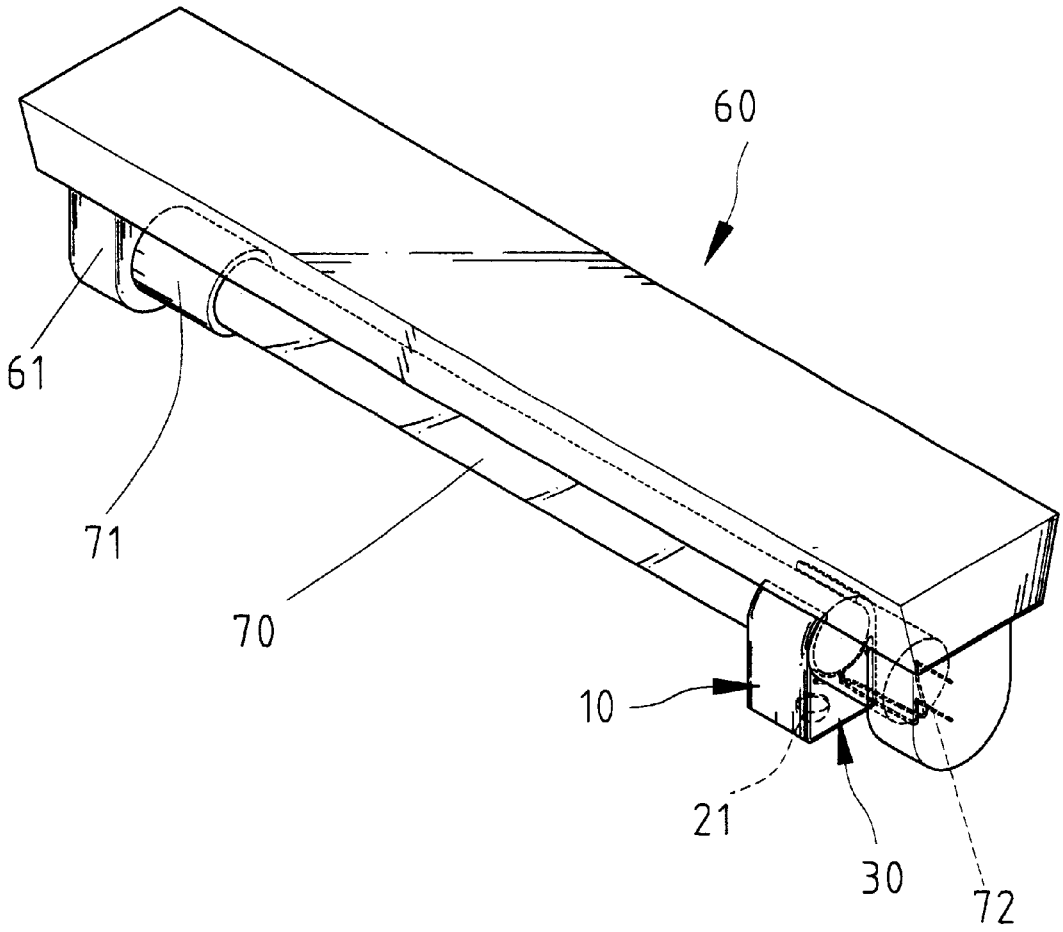
FIG. 2 is a perspective view of a lamp with the automatic on/off device in accordance with the present invention.

In assembly, screws 42 are extended through holes 35 in the panel 30 and holes 221 of the integrated circuit board 22 and then engaged with nuts 50, thereby securing the integrated circuit board 22 to the panel 30. The sensor 21 is inserted into the compartment 16 of the mounting member 10 with the flange 213 resting on the bottom wall defining the compartment 16 and with the lower end 212 of the sensor 21 being exposed outside the mounting member 10. Then, screws 40 are extended through holes 34 in the panel 30 and the screw holes 14 of the mounting member 10, thereby attaching the panel 30 to the mounting member 10 for covering the compartment 16 with the integrated circuit board 22 enclosed in the mounting member 10. Next, as illustrated in FIG. 2, the C-clip holding portion 11 of the mounting member 10 is engaged with a base 71 of a fluorescent bulb 70 that is attached to a lighting element holder 61 of a lamp 60. The leads 211 of the sensor 21 are in contact with two tube pins 72 (power connection) on an end of the fluorescent bulb 70.

Figure 3:
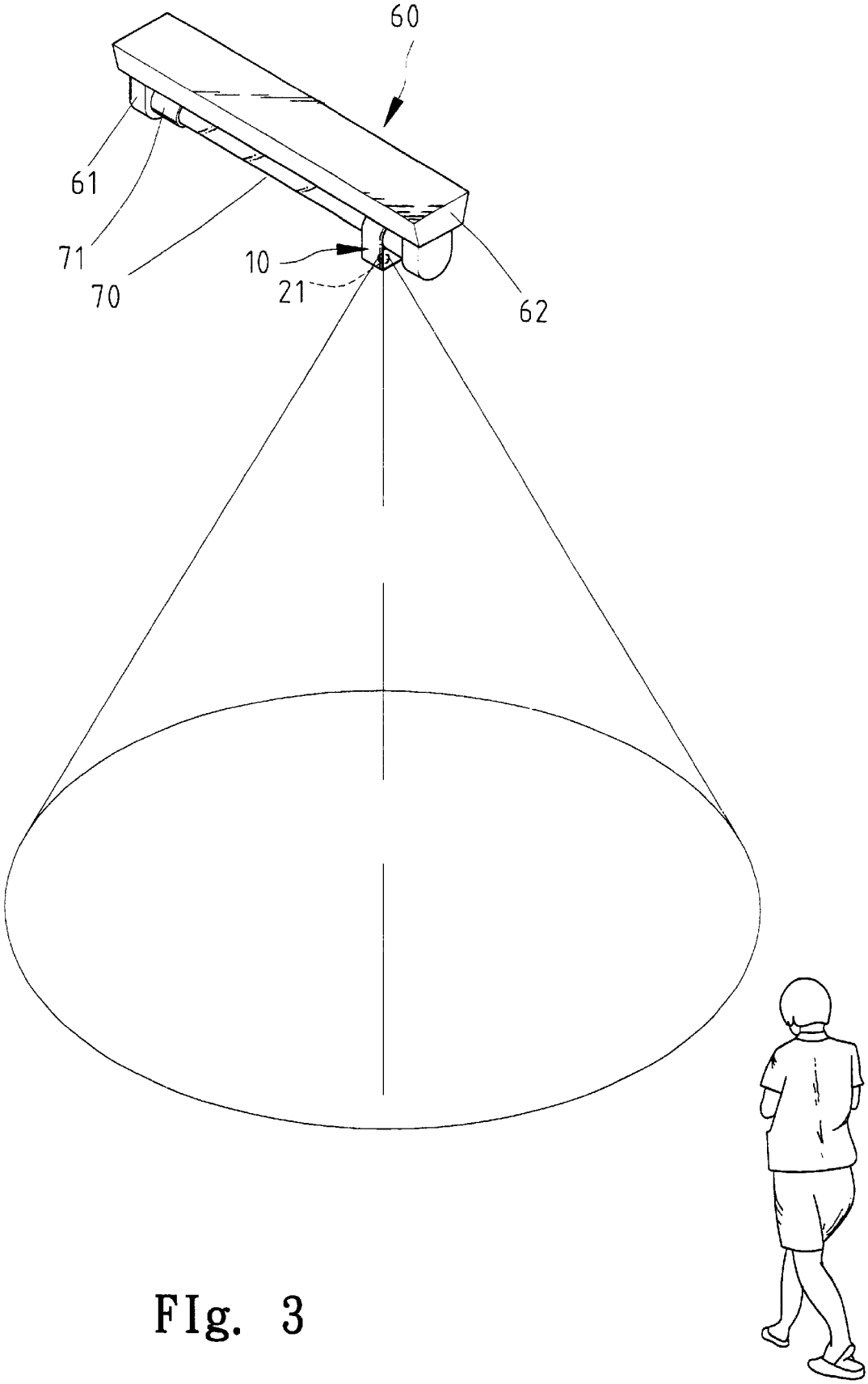
FIGS. 3 and 4 illustrate operation of the automatic on/off device in accordance with the present invention.
Figure 4:
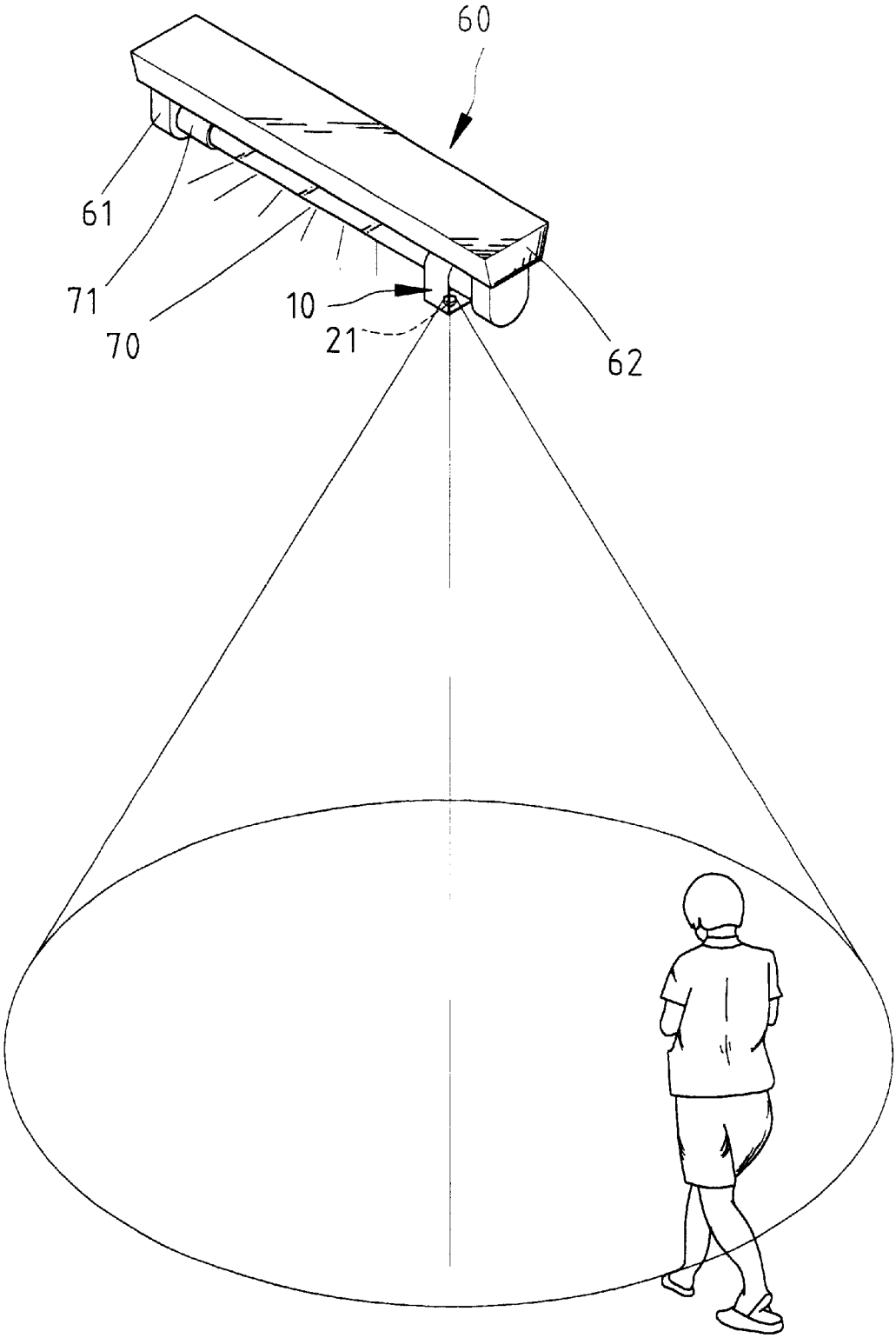

In use, as illustrated in FIG. 3, when the lamp 60 is mounted to a high place or a ceiling and connected with a power source (not shown), the sensor 21 has a predetermined spatial sensing area. When a person is out of the predetermined spatial sensing area, the fluorescent bulb 70 is off. Referring to FIG. 4, when a person enters the predetermined spatial sensing area and sensed by the sensor 21, a signal is sent to the control chip 23 on the integrated circuit board 22 to turn the fluorescent bulb 70 on. It is noted that the automatic on/off device in accordance with the present invention can be conveniently and rapidly attached to a lamp that is currently in use without the need of a professional worker, thereby providing an automatic turning on/off function. Of course, the automatic on/off device in accordance with the present invention can be detached from the lamp 60 easily without the need of a professional worker.

Figure 5:
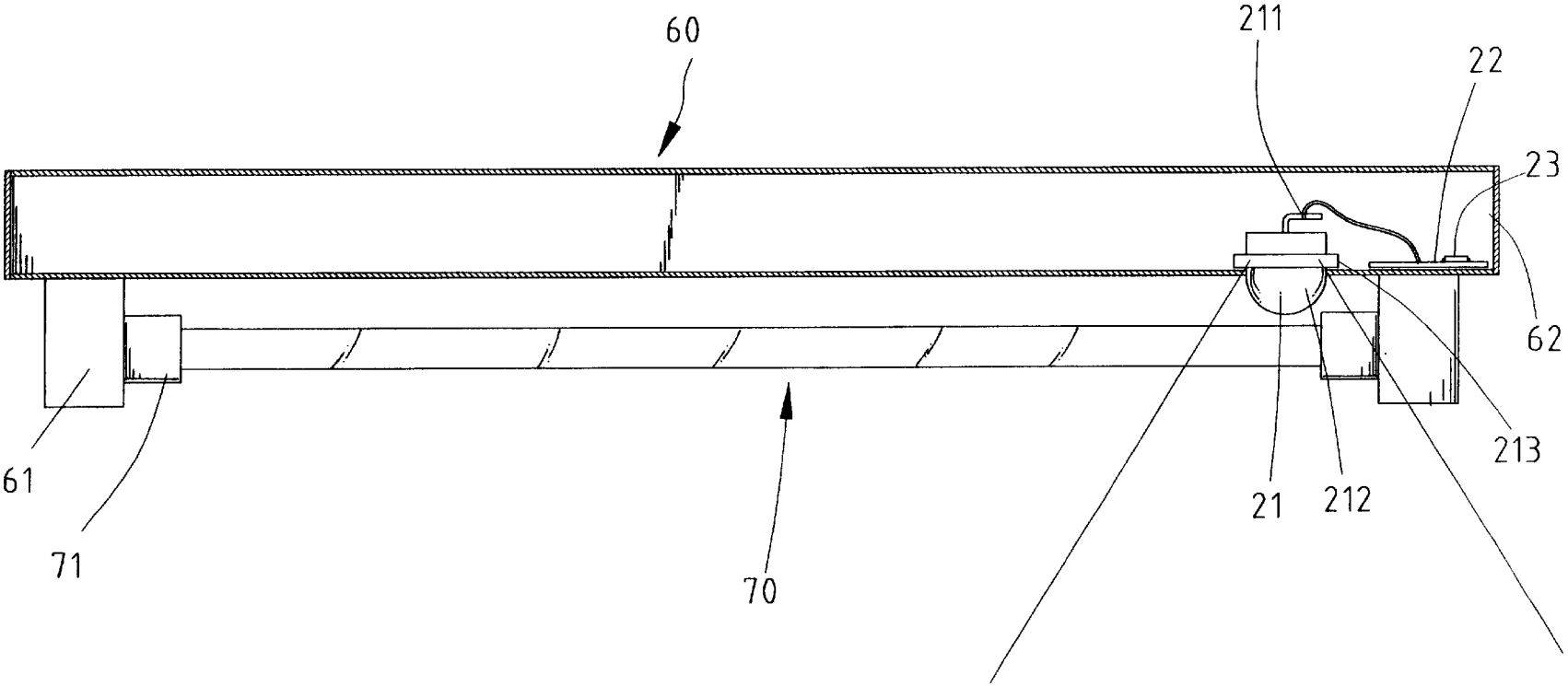
FIG. 5 is a sectional view illustrating a modified embodiment of the present invention.
Figure 6:
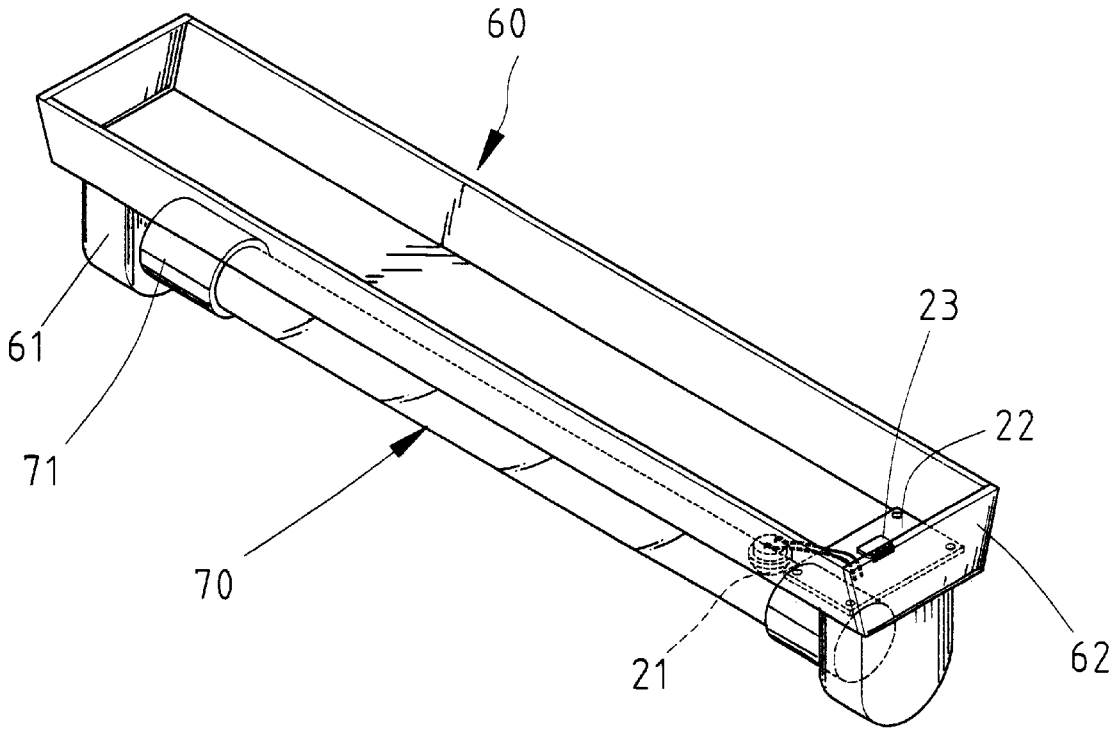
FIG. 6 is a perspective view of the modified embodiment in FIG. 5.
Figure 7:
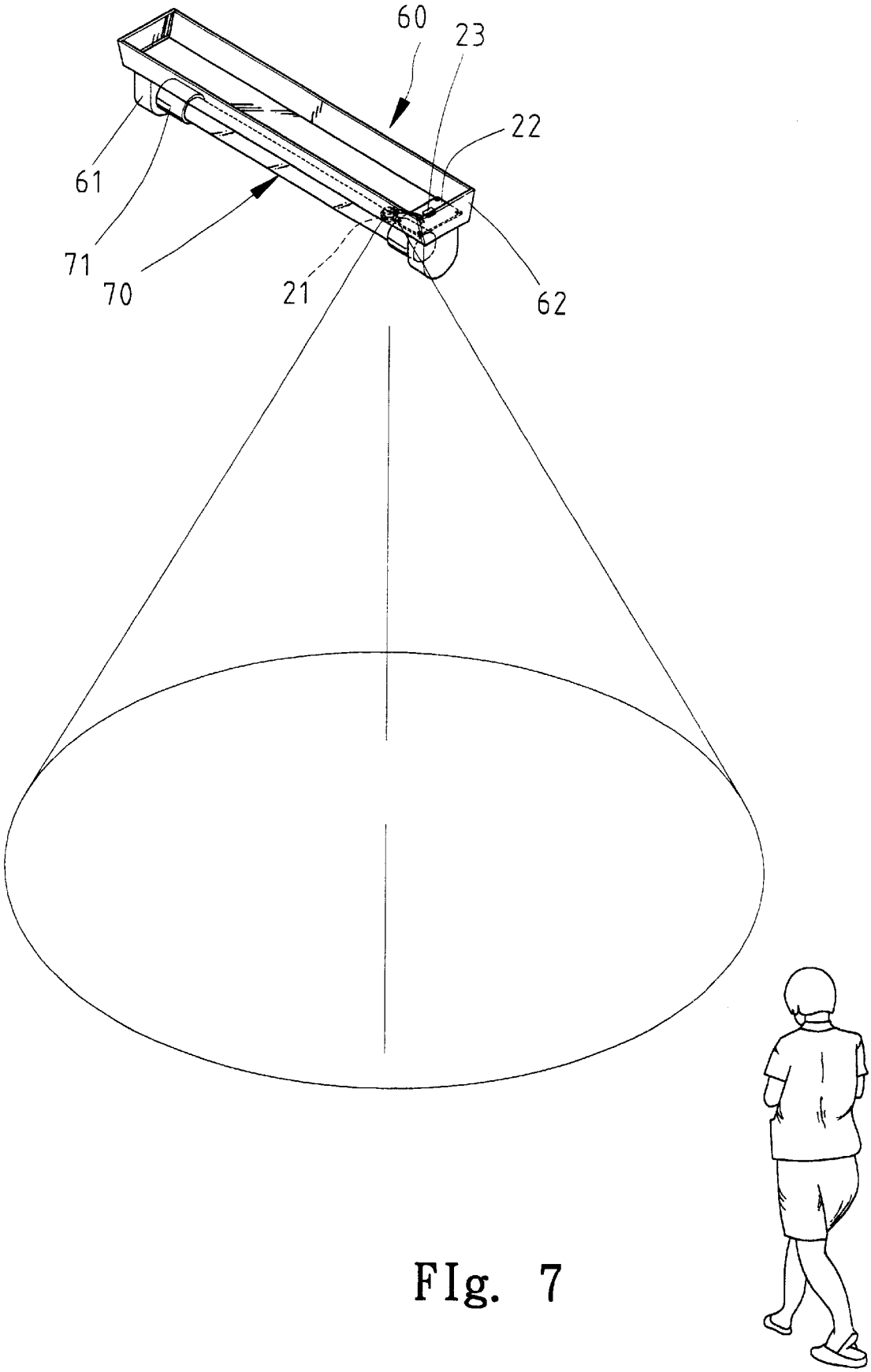
FIGS. 7 and 8 illustrate operation of the modified embodiment in FIG. 5.
Figure 8:
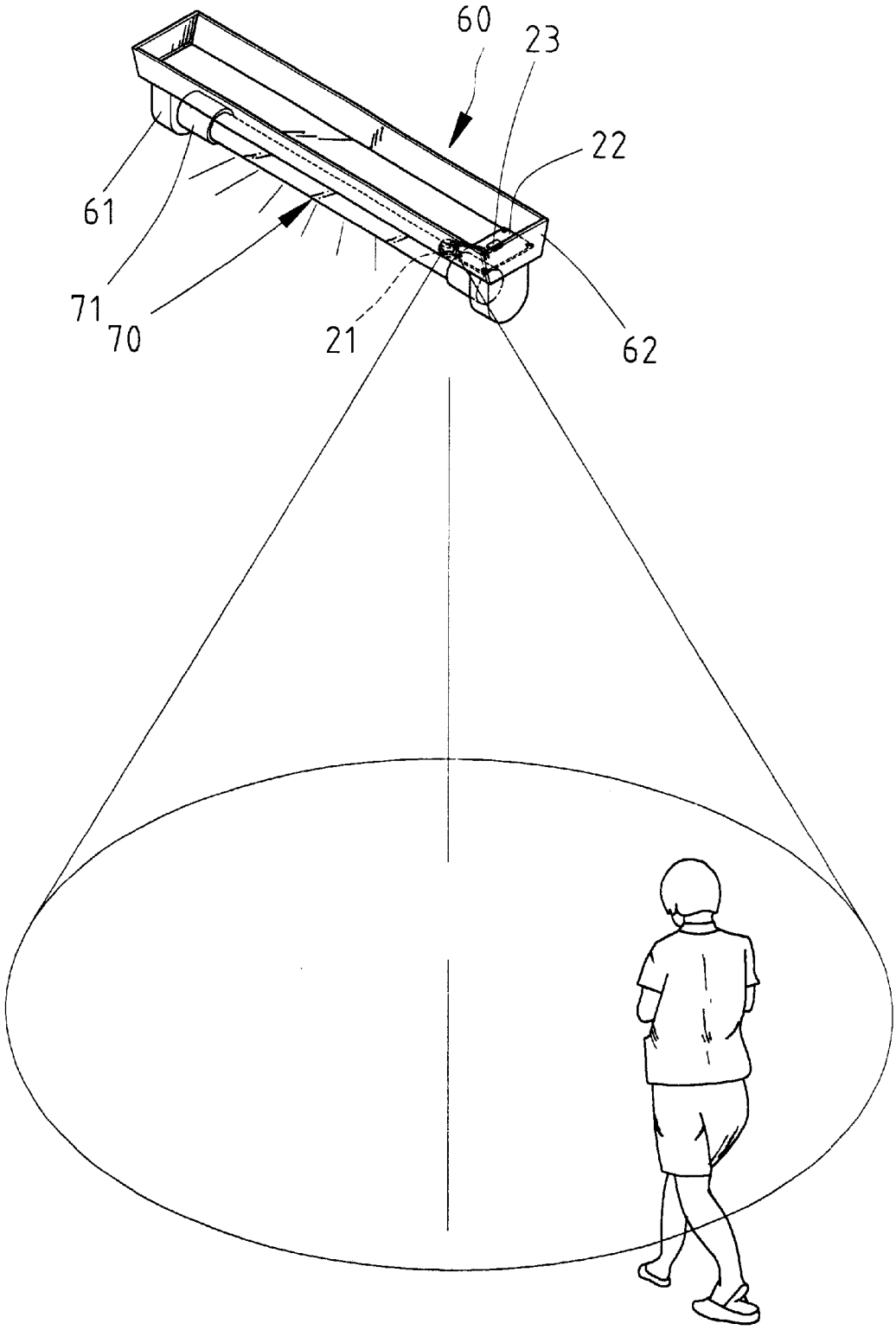

FIGS. 5 and 6 illustrates a modified embodiment of the automatic on/off device in accordance with the present invention. In this embodiment, the automatic on/off device has no mounting member 10 and panel 30. The sensing means 20 is directly mounted in a lamp base 62 of a lamp 60. The lamp base 62 includes a hole (not labeled) to expose the lower end 212 of the sensor 21 to thereby provide the required sensing function. Namely, the flange 213 of the sensor 21 has an outer diameter greater than the hole in the lamp base 62 and the lower portion 211 of the sensor 21 has an outer diameter smaller than the diameter of the hole in the lamp base 62. FIGS. 7 and 8 illustrate operation of the modified embodiment, which is identical to the first embodiment (see FIGS. 3 and 4) and therefore not described again to avoid redundancy.

According to the above description, the automatic on/off device in accordance with the present invention can be directly mounted in a lamp base in a factory without the need of long wires. In an alternative design, the automatic on/off device in accordance with the present invention can be attached to or detached from a lamp that is currently in use without the need of a professional worker and long wires. Destruction of the lamp base is avoided when attaching the automatic on/off device to the lamp. Installation of the automatic on/off device in accordance with the present invention is thus inexpensive and easy in addition to the advantage of saving electricity.

Although the invention has been explained in relation to its preferred embodiment, it is to be understood that many other possible modifications and variations can be made without departing from the scope of the invention as hereinafter claimed.

What is claimed is:

1. An automatic on/off device for a lamp including a lamp base having a hole, the automatic on/off device comprising a sensing means including a power input end for contacting with a power connection of the lamp to form a circuit for controlling on/off of the lamp, wherein the sensing means has a lower portion and a flange above the lower portion, the flange having an outer diameter greater than a diameter of the hole of the lamp base, the lower portion of the sensing means having an outer diameter smaller than the diameter of the hole of the lamp base, with the sensing means located in the hole of the lamp base and the lower portion of the sensing means exposed outside the lamp base.

2. The automatic on/off device for a lamp as claimed in claim 1, wherein the lamp comprises a fluorescent bulb having two ends, each said end of the fluorescent bulb having a base and two tube pins, the sensing means including a sensor with two leads in contact with the tube pins, respectively.

3. The automatic on/off device for a lamp as claimed in claim 2, wherein the automatic on/off device is enclosed in the lamp base.

4. An automatic on/off device for a lamp, the automatic on/off device comprising:

a mounting member to be removably attached to a lamp, with the mounting member having a hole; and a sensing means mounted in the mounting member and including a power input end for contacting with a power connection of the lamp to form a circuit for controlling on/off of the lamp, wherein the sensing means has a lower portion and a flange above the lower portion, the flange having an outer diameter greater than a diameter of the hole of the mounting member, the lower portion of the sensor having an outer diameter smaller than the diameter of the hole of the mounting member, with the lower portion of the sensing means being exposed through the hole of the mounting member.

5. The automatic on/off device for a lamp as claimed in claim 4, wherein the lamp comprises a fluorescent bulb having two ends, each said end of the fluorescent bulb having a base and two tube pins, the sensing means including a sensor with two leads in contact with the tube pins, respectively.

6. The automatic on/off device for a lamp as claimed in claim 5, wherein the mounting member has a hole through which a portion of the sensor is exposed outside the mounting member.

7. An automatic on/off device for a lamp including a fluorescent bulb having two ends each including a base, the automatic on/off device comprising:

a mounting member to be removably attached to a lamp, wherein the mounting member includes a holding portion -for holding the base of one of the ends of the fluorescent bulb; and a sensing means mounted in the mounting member and including a power input end for contacting with a power connection of the lamp to form a circuit for controlling on/off of the lamp.

8. The automatic on/off device for a lamp as claimed in claim 7, wherein each said end of the fluorescent bulb further comprises two tube pins, the sensing means including a sensor with two leads in contact with the tube pins, respectively.

9. The automatic on/off device for a lamp as claimed in claim 8, wherein the mounting member has a hole through which a portion of the sensor is exposed outside the mounting member.

10. An automatic on/off device for a lamp, the automatic on/off device comprising:

a mounting member to be removably attached to a lamp, the mounting member having an opening in a side thereof, a sensing means mounted in the mounting member and including an integrated circuit board, a control chip mounted on the integrated circuit board, and a sensor mounted in the mounting member and having a portion exposed outside the mounting member, the sensor including a power input end for contacting with a power connection of the lamp to form a circuit for controlling on/off of the lamp under cooperation by the control chip; and a panel removably mounted to the side of the mounting member for covering the opening, the integrated circuit board being securely mounted to the panel.

11. The automatic on/off device for a lamp as claimed in claim 10, wherein the mounting member includes an engaging slot and the panel includes a protrusion for releasably engaging with the engaging slot.

12. The automatic on/off device for a lamp as claimed in claim 10, wherein the lamp comprises a fluorescent bulb having two ends, each said end of the fluorescent bulb having a base and two tube pins, the sensor having two leads in contact with the tube pins, respectively.

13. The automatic on/off device for a lamp as claimed in claim 12, wherein the mounting member has a hole through which a portion of the sensor is exposed outside the lamp base.

14. The automatic on/off device for a lamp as claimed in claim 13, wherein the sensor has a lower portion and a flange above the lower portion, the flange having an outer diameter greater than a diameter of the hole of the mounting member, the lower portion of the sensor having an outer diameter smaller than the diameter of the hole of the mounting member.

15. The automatic on/off device for a lamp as claimed in claim 12, wherein the panel includes a slot through which the leads of the sensor extend out of the mounting member for contacting with the tube pins of the fluorescent bulb.

* * * * *